United States Patent [19]

Giuseppe

[11] Patent Number: 4,846,380

[45] Date of Patent: Jul. 11, 1989

[54] FILL SPOUT

[76] Inventor: James D. Giuseppe, 5151 Amigo Ave., Tarzana, Calif. 91356

[21] Appl. No.: 193,749

[22] Filed: May 13, 1988

[51] Int. Cl.[4] ..... B65D 47/00

[52] U.S. Cl. ..... 222/519; 222/549

[58] Field of Search ..... 222/519, 520, 549, 522, 222/523, 524, 521, 499

[56] References Cited

U.S. PATENT DOCUMENTS

| | | | |
|---|---|---|---|
| 920,273 | 5/1909 | Coons | 222/519 |
| 1,862,973 | 6/1932 | McDonald | 222/519 |
| 1,912,304 | 5/1933 | Phillips | 222/524 |
| 2,165,825 | 7/1939 | Bultzingslowen | 222/519 |
| 2,597,165 | 5/1952 | Minturn | 222/513 |
| 2,851,202 | 9/1958 | Bradbury | 222/505 |
| 3,690,520 | 9/1972 | Sarris | 222/499 |
| 3,915,359 | 10/1975 | Feldman | 222/514 |
| 4,544,063 | 10/1985 | Neward | 206/540 |

FOREIGN PATENT DOCUMENTS

| | | | |
|---|---|---|---|
| 515688 | 2/1955 | Italy | 222/519 |

*Primary Examiner*—Kevin Shaver
*Assistant Examiner*—Kenneth Noland
*Attorney, Agent, or Firm*—Fleit, Jacobson, Cohn, Price, Holman & Stern

[57] ABSTRACT

An elongated pouring spout is provided incorporating relatively rotatable inner and outer tubular members which are longitudinally shiftable and relatively rotatable relative to each other. The spout includes inlet and outlet ends and the outlet end of the outer tubular member is closed by an end wall and includes a plurality of peripherally spaced and radially outwardly opening ports formed therein adjacent the end wall. The outlet end of the inner tubular member is open and includes a beveled (innerside) end edge sealingly seatable in a circumferential groove formed in the inner surface of the end wall and the inlet end of the inner tubular member projects outward of the inlet end of the outer tubular member. Further, the inlet end of the spout defines a pin and slot connection between the inner and outer tubular members whereby relative rotational oscillation of the inner and outer tubular members will cause relative longitudinal reciprocation thereof.

10 Claims, 1 Drawing Sheet

FILL SPOUT

BACKGROUND OF THE INVENTION

1. Field of the Invention

This invention relates to an elongated tubular structure including opposite inlet and outlet ends and provided with structure at the outlet end thereof for selectively opening and positively closing the tubular construction against the discharge of liquid from the outlet end, the inlet end being open and incorporating a threaded counter bore into which the threaded neck of a liquid container may be removably secured, a resilient neck equipped with a circumferential clamp into which the outlet neck of a container of liquid may be sealingly secured or a funnel-shaped extension into which liquid may be poured.

The pouring spout is designed, primarily, to provide a means by which, for example, liquid lubricant may be poured from a container thereof into the appropriate fill opening of an automotive engine or transmission without spillage of the liquid being poured. Of course, the pouring spout also may be used to advantage in other environments.

2. Description of Related Art

Various different forms of funnels and pouring spouts including some of the general structural and operational features of the instant invention heretofore have been provided such as those disclosed in U.S. Pat. Nos. 1,862,973, 1,912,304, 2,165,825, 2,597,165, 2,851,202, 3,690,520, 3,915,359 and 4,544,063. However, these previously known devices do not include the overall combination of structural and operational features incorporated in the instant invention.

SUMMARY OF THE INVENTION

The pouring spout of the instant invention is constructed in a manner whereby liquids may be poured therethrough and the discharge of liquids therefrom may be terminated at any desired time in a manner minimizing drippage of liquid from the outlet end of the pouring spout.

The pouring spout may be constructed in the form of a funnel, or it may be constructed for ready removable attachment to the outlet neck of a container of liquid.

The main object of this invention is to provide a pouring spout specifically designed for use in pouring liquids into various liquid reservoirs in the engine compartments of vehicles. The pouring spout may be used for automatic transmission fluid, engine oil, power steering fluid, coolant fluids, and windshield washing fluids, etc.

Although the pouring spout has been specifically designed for use in the automotive field, it is also handily usable in other environments in which drippage of fluids being poured should be maintained at a minimum.

The main object of this invention is to provide a pouring spout through which liquids may be conveniently poured for discharge into liquid reservoirs which are hard to reach.

Another object of this invention is to provide a pouring spout constructed in a manner by which the discharge of liquids therefrom may be quickly terminated whenever desired with a minimum amount of drippage.

Still another important object of this invention is to provide a pouring spout in accordance with the preceding objects and which may be adapted to the outlet necks of various fluid containers.

Another very important object of this invention is to provide a pouring spout which may be used in many different environments and for pouring many different fluids.

A final object of this invention to be specifically enumerated herein is to provide a pouring spout in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
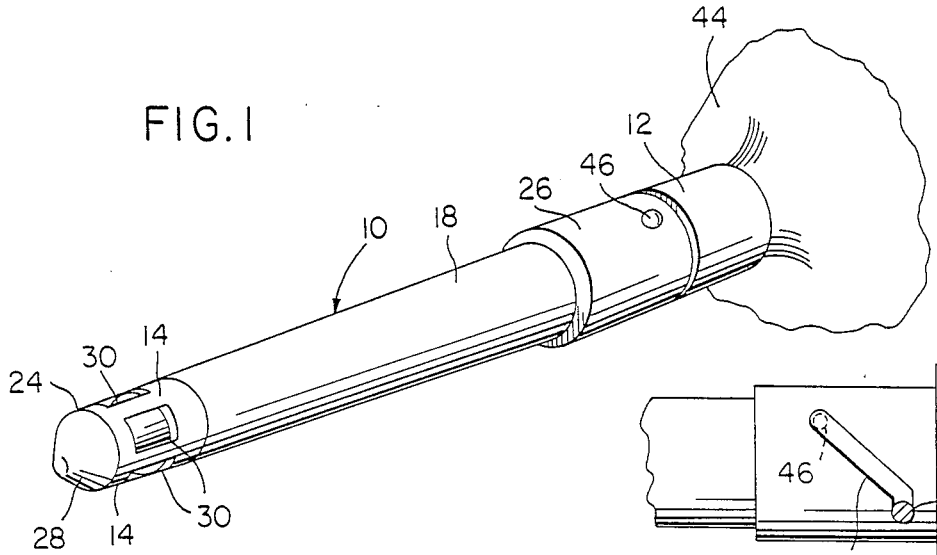
FIG. 1 is a perspective view of a first form of pouring spout constructed in accordance with the present invention and with the inlet end of the pouring spout removably threadedly supported from the externally threaded outlet neck of a liquid container.

Referring now more specifically to the drawings, the numeral 10 generally designates a first form of fill spout constructed in accordance with the present invention. The fill spout 10 comprises a pouring spout including inlet and outlet ends 12 and 14 and incorporates inner and outer telescoped tubular members. The inner tubular member 16 includes first and second ends 20 and 22 and the outer tubular member 18 includes first and second ends 24 and 26, the first and second ends being disposed at the outlet and inlet ends, respectively, of the fill or pouring spout 10.

The first end 24 of the outer tubular member 18 is closed by an integral, shallow conical end wall 28 and the outer tubular member 18 includes a plurality (four) circumferentially spaced radial outlet openings 30 formed therein closely adjacent the end wall 28.

The first end 20 of the inner tubular member 16 is open and includes a beveled peripheral end edge 32 which is beveled on the innerside and seated within an annular groove 34 of the same cross sectional shape extending about the outer periphery of the inner surface of the end wall 28.

The first ends 20 and 24 of the member 16 and 18 are of constant diameter from the transverse plane P to the conical end wall 28 of the outer tubular member 18. From the plane P toward the inlet end 12 of the spout 10 the inner and outer tubular members 18 are slightly tapered and flare toward the inlet end 12.

The second end 22 of the inner tubular member 16 includes first and second diametrically enlarged sections 36 and 38 and the second end 26 of the outer tubular member 18 includes a diametrically enlarged section 40 disposed over the section 36, the section 38 including internal threads 42 for removable threaded engagement with the externally threaded neck of a container 44 of liquid to be poured through the spout 10. In addition, the section 40 includes a radially inwardly projecting pin 46 received within a cam slot 48 formed in the outer surface of the section 36.

The tubular members 16 and 18 are not only telescopingly engaged but are also rotatable relative to each other and longitudinally shiftable relative to each other, there being only minimal clearance between the inner and outer tubular members 16 and 18 from the inlet end 12 of the spout 10 to the end wall 28 and the diameters of the inner and outer tubular members 16 and 18 being constant from the plane P to the end wall 28.

Figure 3:
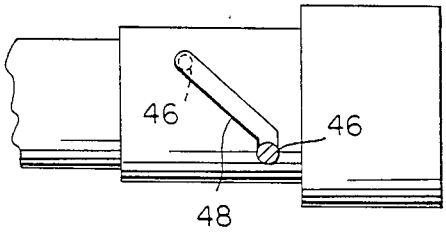
FIG. 3 is a fragmentary top plan view of the inlet end of the inner tubular member of the pouring spout and illustrating the cam track slot formed therein with the cam pin carried by the outer tubular member illustrated in section at one end of the cam slot.
Figure 2:
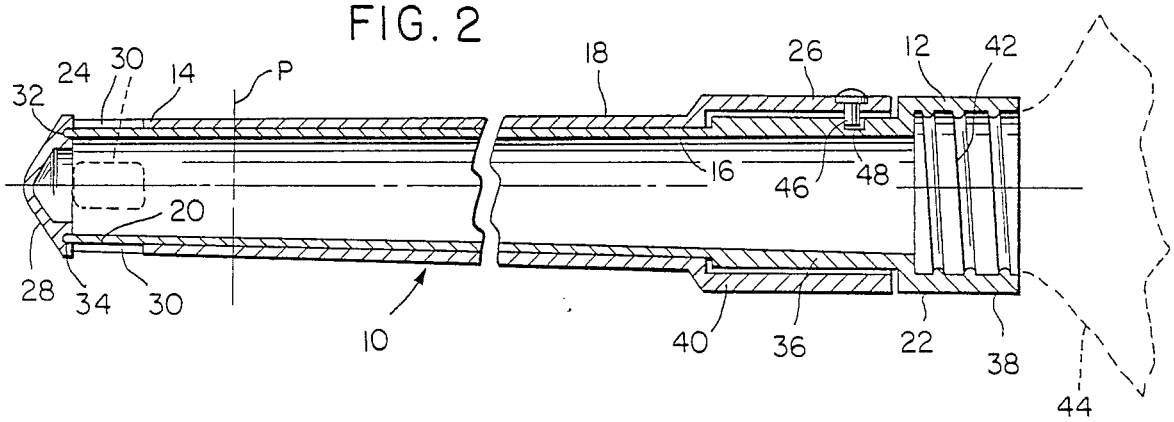
FIG. 2 is a fragmentary enlarged longitudinal vertical sectional view taken substantially upon a plane extending along the longitudinal center line of the pouring spout.

When the pin 46 is disposed in the end of the slot 48 in the manner illustrated in solid lines in FIG. 3, the end wall 28 is retracted into tight seated engagement with the end edge 32 of the inner tubular member 16. The open end of the inner tubular member 16 is tightly sealingly seated within the groove 34 and closes the openings 30. In this manner, no fluid may be discharged from the spout 10 when the outlet end 14 thereof is disposed lower than the inlet end 12. However, when the spout 10 has the section 38 thereof tightly threadedly engaged with the neck of the liquid container 44, the container 44 and pouring spout 10 may be inverted and position in readiness to discharge liquid from the container 44 through the pouring spout and into a reservoir to receive the liquid.

This prepositioning of the container 44 and the spout 10, for example, may be accomplished when adding oil to a vehicle engine. Of course, the cover for the lubricating oil intake of the associated engine is first removed and thereafter the outlet end 14 of the pouring spout 10 is placed through the lubricating oil receiving opening of the engine.

Then, it is merely necessary to rotate the outer tubular member 18 relative to the inner tubular member 16 so that the pin 46 will move through the slot 48 from the solid line position of the pin illustrated in FIG. 3 to the phantom line position thereof illustrated in FIG. 3. When this occurs, the first end of the outer tubular member 18 is outwardly displaced relative to the first end 20 of the inner tubular member 16 and the groove 34 is retracted from the beveled (innerside) end edge 32 and the openings 30 are uncovered. This will, of course, allow liquid to flow from the container 44 through the pouring spout 10 and into the lubricating oil receiving portion of the associated engine.

If, however, only one half or other fraction of the liquid within the container 44 is to be dispensed through the pouring spout 10, the flow of liquid from the container 44 and through the spout 10 may be terminated at any time be merely rotating the outer tubular member 18 relative to the inner tubular member 16 so as to again position the pin 46 as illustrated in solid lines in FIG. 3. This, of course, will again cause the open first end 20 of the inner tubular member 16 to be tightly sealingly seated in the groove 34.

The outer diameter of the section 40 is substantially identical to the outer diameter of the section 38 and the entire fill or pouring spout 10 may be constructed of any suitable plastic.

Figure 4:
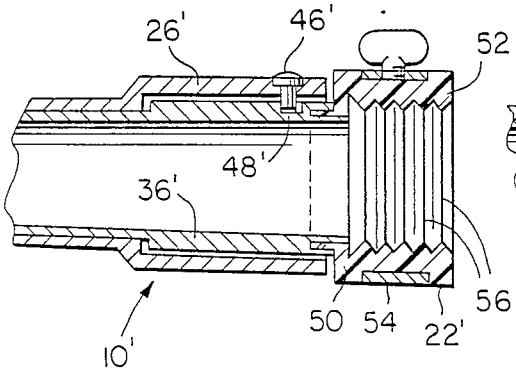
FIG. 4 is a fragmentary longitudinal vertical sectional view similar to FIG. 2, but illustrating a second form of the invention adapted to be sealingly supported from a container pouring neck having a smooth outer surface.

With reference now to FIG. 4, a modified form of pour spout is referred to in general by the reference numeral 10' and is only fragmentarily illustrated. However, those portions of the pouring spout 10' which correspond to the various components of the pouring spout 10 are designated by corresponding prime reference numerals.

The pouring spout 10' differs from the pouring spout 10 in that the second end 22' of the pouring spout 10' includes a tubular rubber nipple 52 rather than an integral section such as the section 38 of the pouring spout 10. The rubber nipple 52 includes an external contractable clamp 54 and includes internal axially spaced and circumferentially extending ribs 56 for forming a fluid tight seal with the outer surface of the neck of an associated container of liquid similar to the container 44.

Figure 5:
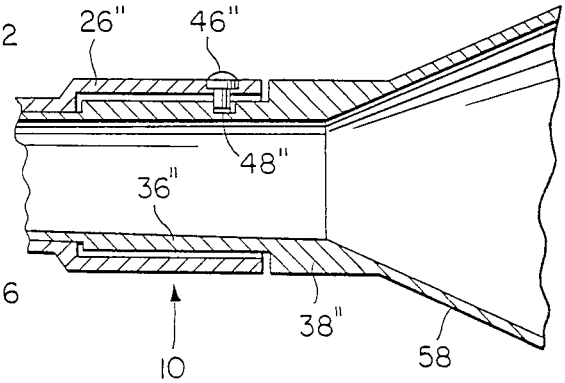
FIG. 5 is a fragmentary sectional view similar to FIG. 2, but illustrating a third form of the invention including an outwardly flaring funnel on its inlet end.

With attention now invited to FIG. 5, a third form of pouring spout is referred to in general by the reference numeral 10''. The pouring spout 10'' differs from the pouring spout 10 in that the section 38'' thereof includes an outwardly flaring funnel section 58. Otherwise, the pouring spouts 10 and 10' are identical to the pouring spout 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An elongated tubular pouring spout having opposite inlet and outlet ends, said tubular spout including inner and outer telescoped tubular members having corresponding first and second ends at said outlet and inlet ends, respectively, of said spout, said first end of said outer tubular member including a closure end wall and at least one lateral outlet opening radially outwardly therefrom closely adjacent said closure end wall, said first end of said inner tubular member being open and seated against said closure end wall in fluid-tight sealed engagement therewith, said outer tubular member being shiftably received about said inner tubular member for at least limited longitudinal shifting relative thereto from a first position with said first end of said inner tubular member seated against said closure end wall to a second position with said open first end of said inner tubular member retracted from seated engagement with said closure end wall and positioned with at least a portion of said lateral opening uncovered thereby, shifting means operatively connected between said inner and outer tubular members to effect shifting of said inner tubular member between the first and second positions thereof, the length of said outer tubular member being at least four times the width thereof centrally intermediate its opposite ends, said second end of said inner tubular member projecting outwardly of the second end of said outer tubular member and enabling manual gripping of said second end of said outer tubular member and manual gripping of said second end of saaid inner tubular member at said inlet end of said pouring spout and in closely adjacent longitudinally spaced zones thereof, said inner and outer tubular members being relatively rotatable about a center longitudinal axis of said spout, said shifting means including a pin and slot connection between said inner and outer tubular members wherein relative rotational oscillation thereof will effect longitudinal shifting of said outer tubular member between said first and second positions thereof.

2. The spout of claim 1 wherein said first end of said outer tubular member includes a plurality of circumferentially spaced lateral openings therein which are at least partially uncovered by said first end of said inner tubular member when said outer tubular member is in the second position thereof.

3. The spout of claim 1 wherein said lateral openings equal four in number.

4. The spout of claim 1 wherein said second end of said inner tubular member includes an outwardly flared terminal end projecting outward from the second end of said outer tubular member.

5. The spout of claim 1 wherein said second end of said inner tubular member includes an internally threaded counter bore defining terminal end into which the externally threaded neck of a container of liquid may be removably threadedly engaged.

6. The spout of claim 1 wherein said second end of said inner tubular member includes a resilient sleeve supported therefrom into which the outlet neck of a container of liquid may be snugly telescoped.

7. The spout of claim 6 wherein said resilient sleeve includes an outer clamp structure thereon for clampingly tightening said sleeve about said outlet neck.

8. The spout of claim 1 wherein said pin and slot connection includes a radially inwardly projecting projection carried by said second end of said outer tubular member and a peripherally extending elongated slot formed in the outer surface of said second end of said inner tubular member in which said projection is slidingly received, said slot including at least an intermediate length portion thereof inclined relative to a plane normal to said center axis.

9. The spout of claim 1 wherein said closure end wall includes an inner surface defining an annular groove formed therein opening toward said second end of said outer tubular member and coaxial with the center longitudinal axis of said spout, said open of said inner tubular member being seated in said groove.

10. The spout of claim 9 wherein said groove includes a bottom which is semicircular in radial cross sectional shape, said open end of said inner tubular member including a peripheral end edge which is internally beveled.

* * * * *
* * * * *

UNITED STATES PATENT AND TRADEMARK OFFICE

CERTIFICATE OF CORRECTION

PATENT NO. : 4,846,380

DATED : July 11, 1989

INVENTOR(S) : JAMES DI GIUSEPPE

It is certified that error appears in the above-identified patent and that said Letters Patent is hereby corrected as shown below:

Title page, number[19], in the inventor's name, delete "Giuseppe" and substitute--Di Giuseppe--.

Title page, number[76], in the inventor's name, delete "D. Giuseppe" and insert--Di Giuseppe--.

Signed and Sealed this

Twenty-ninth Day of May, 1990

*Attest:*

HARRY F. MANBECK, JR.

*Attesting Officer*

*Commissioner of Patents and Trademarks*